US008036571B2

(12) United States Patent
Imanaka et al.

(10) Patent No.: US 8,036,571 B2
(45) Date of Patent: Oct. 11, 2011

(54) IMAGE FORMING APPARATUS

(75) Inventors: Yoshitaka Imanaka, Osaka (JP); Shinki Miyaji, Osaka (JP)

(73) Assignee: Kyocera Mita Corporation (JP)

( * ) Notice: Subject to any disclaimer, the term of this patent is extended or adjusted under 35 U.S.C. 154(b) by 282 days.

(21) Appl. No.: 12/402,104

(22) Filed: Mar. 11, 2009

(65) Prior Publication Data

US 2009/0232544 A1 Sep. 17, 2009

(30) Foreign Application Priority Data

Mar. 14, 2008 (JP) ..... 2008-065418

(51) Int. Cl.

| | |
|---|---|
| ***G03G 21/18*** | (2006.01) |
| *G03G 15/02* | (2006.01) |
| *G03G 15/00* | (2006.01) |

(52) U.S. Cl. ..... 399/115; 399/159; 399/176

(58) Field of Classification Search ..... 399/115, 399/176, 159, 303, 270

See application file for complete search history.

(56) References Cited

U.S. PATENT DOCUMENTS

| | | | | |
|---|---|---|---|---|
| 5,572,293 | A * | 11/1996 | Kikuchi et al. | 399/357 |
| 6,385,427 | B1 * | 5/2002 | Nakane | 399/303 |
| 2004/0013448 | A1 * | 1/2004 | Lee | 399/159 |
| 2006/0233573 | A1 * | 10/2006 | Kichijima et al. | 399/270 |

FOREIGN PATENT DOCUMENTS

| | | |
|---|---|---|
| JP | 3587094 | 2/2004 |
| JP | 2005-346028 | 12/2005 |

* cited by examiner

*Primary Examiner* — David Porta
*Assistant Examiner* — Faye Boosalis
(74) *Attorney, Agent, or Firm* — Gerald E. Hespos; Michael J. Porco

(57) ABSTRACT

An image forming apparatus includes a plurality of image forming units arranged in parallel, each image forming unit having an image carrying member and a charging roller disposed face to face with the image carrying member for electrically charging the image carrying member, and a shifting mechanism for selectively shifting at least one charging roller between a first position where the charging roller is brought into contact with the corresponding image carrying member to electrically charge the image carrying member in contact manner and a second position where the charging roller is moved away from the corresponding image carrying member to electrically charge the image carrying member in non-contact manner.

12 Claims, 6 Drawing Sheets

IMAGE FORMING APPARATUS

BACKGROUND OF THE INVENTION

1. Field of the Invention

The present invention relates to an image forming apparatus using electrophotographic technology and, more particularly, relates to a charging device for electrically charging a photosensitive drum.

2. Description of the Related Art

FIG. 7 is a schematic diagram of a conventional tandem-type color image forming apparatus (printer) 100, and FIG. 8 is a diagram showing the configuration of a portion of the image forming apparatus 100 of FIG. 7 around charging rollers 2*a*, 2*b*, 2*c* and 2*d* and photosensitive drums 1*a*, 1*b*, 1*c* and 1*d*. The image forming apparatus 100 incorporates within a main apparatus body thereof four image forming units Pa, Pb, Pc and Pd which are arranged in this order from an upstream side to a downstream side along a sheet feeding direction (right to left as depicted in FIG. 7) of a sheet P. Provided for forming images in four different colors (i.e., magenta, cyan, yellow and black), these image forming units Pa to Pd individually perform steps of charging, exposure, development and image transfer to sequentially produce magenta, cyan, yellow and black images.

The image forming units Pa, Pb, Pc and Pd include the photosensitive drums (image carrying members) 1*a*, 1*b*, 1*c* and 1*d* which carry visible images (toner images) of the aforementioned four colors, respectively. Driven by a belt driving source (not shown), a transport belt 50 transports a sheet P while turning counterclockwise as shown by an arrow in FIG. 7 in contact relation with the individual image forming units Pa to Pd. The toner images formed on the individual photosensitive drums 1*a* to 1*d* are successively transferred onto the sheet P as the same is conveyed by the transport belt 50. The toner images so transferred on the sheet P are fixed thereto in a fixing unit 7, and then the sheet P is discharged to the outside of the apparatus main body. The photosensitive drums 1*a* to 1*d* are rotated clockwise in FIG. 7 while the image forming process is performed.

Sheets P to which toner images are transferred are stored in a paper cassette 16 provided at the bottom of the main apparatus body. The sheet P is fed to the image forming units Pa to Pd by a sheet feeding roller 12*a* and registration rollers 12*b*. The transport belt 50 is made of a dielectric plastic sheet of which flange portions are lapped and spliced to form an endless belt or formed into a seamless belt. On the upstream side of a driven roller 11, there is provided a cleaning blade 19 for removing residual toners adhering to the transport belt 50.

Next, the image forming units Pa to Pd are described. In spaces around and above the rotatably mounted photosensitive drums 1*a*, 1*b*, 1*c*, 1*d*, there are provided the charging rollers 2*a*, 2*b*, 2*c*, 2*d* for electrically charging the photosensitive drums 1*a*, 1*b*, 1*c*, 1*d*, light-emitting diode (LED) heads 4*a*, 4*b*, 4*c*, 4*d* for exposing the photosensitive drums 1*a*, 1*b*, 1*c*, 1*d* based on image information, development units 3*a*, 3*b*, 3*c*, 3*d* for forming toner images on the photosensitive drums 1*a*, 1*b*, 1*c*, 1*d*, and cleaning units 5*a*, 5*b*, 5*c*, 5*d* for removing developers (toners) left unused on the photosensitive drums 1*a*, 1*b*, 1*c*, 1*d*, respectively.

When a user enters an instruction for starting an image forming task, the image forming apparatus 100 first causes the charging rollers 2*a* to 2*d* to uniformly charge surfaces of the photosensitive drums 1*a* to 1*d*. The charging rollers 2*a* to 2*d* are chargers of a type which applies a voltage to uniformly charge the drum surfaces under conditions where the chargers are held in contact with the surfaces of the photosensitive drums 1*a* to 1*d*. Often used as these chargers are, in particular, charging rollers which are made of high-resistance rubber rollers.

Subsequently, the LED heads 4*a* to 4*d* emit light to form electrostatic latent images on the individual photosensitive drums 1*a* to 1*d* according to image signals. The development units 3*a* to 3*d* include development rollers (developer carrying members) mounted face to face with the photosensitive drums 1*a* to 1*d* and are filled with specific amounts of magenta, cyan, yellow and black toners by toner filling units (not shown) for filling the relevant color toners. The color toners are supplied to the photosensitive drums 1*a* to 1*d* by the development rollers of the development units 3*a* to 3*d* and electrostatically adhere thereto, thereby forming color toner images having the same patterns as the electrostatic latent images formed when exposed by the LED heads 4*a* to 4*d*, respectively.

After an electric field to the transport belt 50 is created by applying a specific transfer voltage thereto, the magenta, cyan, yellow and black toner images on the photosensitive drums 1*a* to 1*d* are sequentially transferred to the sheet P, conveyed by the transport belt 50, by means of respective transfer rollers 6*a*, 6*b*, 6*c*, 6*d*. These four color images are transferred to the sheet P with a predefined positional relationship for forming a desired full-color image. Then, in preparation of a succeeding electrostatic latent image forming task, residual toners left unused on the photosensitive drums 1*a* to 1*d* are scraped off by cleaning blades 5*aa*, 5*ba*, 5*ca*, 5*da* provided in the respective cleaning units 5*a* to 5*d* as shown in FIG. 8.

The transport belt 50 is tensioned between a driving roller 10 and the driven roller 11 and turns counterclockwise as illustrated when the driving roller 10 is driven to rotate by a driving motor (not shown). As the transport belt 50 turns counterclockwise, the sheet P is fed with correct timing by the registration rollers 12*b* to the image forming units Pa to Pd, in which the individual color toner images are sequentially transferred to the sheet P at nips formed between the individual photosensitive drums 1*a* to 1*d* and the transport belt 50 to produce the full-color toner image on the sheet P. The sheet P carrying the full-color toner image is then fed into the fixing unit 7.

As the sheet P fed into the fixing unit 7 passes through a nip (fixing nip) formed between a pair of fixing rollers 13, the toner image is fixed to a surface of the sheet P due to application of heat and pressure by the fixing rollers 13 and, at this point, the desired full-color image is completed. The sheet P carrying the completed full-color image is discharged onto a sheet delivery tray 17 by discharge rollers 15. When producing a monochrome image, on the other hand, the image forming apparatus 100 carries out an image forming task by operating the image forming unit Pd alone in essentially the same way as discussed above.

In the image forming apparatus employing the electrophotographic technology, the magenta, cyan, yellow and black toner images formed on the surfaces of the photosensitive drums 1*a* to 1*d* are sequentially transferred to the sheet (recording medium) P as the recording medium goes into contact with the individual photosensitive drums 1*a* to 1*d* carrying the color toner images. In full-color mode for forming a full-color image, all of the photosensitive drums 1*a* to 1*d* are electrically charged by the respective charging rollers 2*a* to 2*d* to produce magenta, cyan, yellow and black toner images, whereas in monochrome mode for forming a monochrome image, only the photosensitive drum 1*d* is electrically charged by the charging roller 2*d* to produce a black toner image.

Commercially, however, the image forming apparatus is operated more often in the monochrome mode for forming (printing) monochrome images than in the full-color mode for forming (printing) full-color images, so that the charging roller 2*d* for black is used more often than the other charging rollers 2*a*-2*c* for the three different colors. As a result, the charging roller 2*d* wears out more quickly compared to the other charging rollers 2*a*-2*c*. Since the life of the charging roller 2*d* becomes shorter than those of the charging rollers 2*a*-2*c*, the charging roller 2*d* needs to be replaced earlier than the other charging rollers 2*a* to 2*c*.

Under such circumstances, after replacing the charging roller 2*d*, it would be necessary to replace one or more of the charging rollers 2*a*-2*c* depending on the degree of wear of these charging rollers 2*a*-2*c*. Therefore, compared to a case where all of the charging rollers 2*a* to 2*d* for black and individual colors are replaced at once, a practice of replacing the charging rollers 2*a*-2*c* results in almost twice as long down time of the image forming apparatus, and this imposes considerable work load to the user and service personnel.

To cope with the aforementioned problem of the conventional color image forming apparatus, various methods for lengthening the useful life of the charging roller for black have been proposed. For example, Japanese Patent No. 3587094 describes a tandem-type color image forming apparatus having a plurality of photosensitive drums, in which a charging device accompanying a photosensitive drum on which a black toner image is formed is a non-contact-type charger and charging devices accompanying photosensitive drums on which color toner images (other than the black toner image) are formed are contact-type charging rollers. This arrangement is intended to reduce wear of the photosensitive drums for black toner image due to contact with the charging roller, making it possible to use the photosensitive drums and the corresponding charging devices for the individual colors for the same period of time and eventually reduce running cost.

On the other hand, Japanese Unexamined Patent Publication No. 2005-346028 describes an image forming apparatus in which charging devices employing charging rollers which are held out of contact with image carrying members. Specifically, each of the charging rollers includes a core metal, a charging member made of a conductive resin material and integrally mounted around the core metal, and a gap spacing member made of an insulating resin material and mounted on both ends of the charging member. This arrangement is intended to maintain a highly accurate charging gap, reduce changes and deviation of the charging gap as well as smearing of each charging roller, prevent the occurrence of abnormal images, and achieve a cost reduction and enhanced durability.

The arrangement of Japanese Patent No. 3587094 however employs a corotron charger for black toner image forming, and the use of the corotron (or scorotron) charger can potentially result in an increase in the amount of ozone emission. In particular, if the apparatus is of a type using an amorphous silicon (a-Si) type photosensitive drum, the amount of ozone emission increases even more as it is necessary to supply an enormous amount of charging current to the corotron charger.

Additionally, in a case where the charger and the corresponding photosensitive drum are combined into a single unit, it would be necessary to replace the complete unit when the useful life of the charger is over. This makes it necessary to design the charger to have a longer useful life. Especially when the charger is used to electrically charge an a-Si type photosensitive drum, the useful life of the charger tends to become shorter compared to a case where the charger is used to charge an organic photosensitive drum, so that this arrangement would have greater influence on the useful life of the charger.

For reasons stated above, it is necessary to use a charging roller, as the charger for black toner image forming, which emits a smaller amount of ozone and to lengthen the useful life of the charger. Also, if an external toner additive or the like which are not scraped off by a cleaning blade for collecting residual toners left unused on the photosensitive drums adheres to the charging rollers, the useful life of the charging rollers is likely to become shorter. Thus, in order to ensure that the charging rollers for the four colors (including black) are to be replaced at the same time, it is necessary to reduce the amount of the external toner additive or the like adhering to a surface of the charging roller for black.

Furthermore, some users may use a particular color more often than the other colors. Accordingly, the charging roller for such specific color is required to have a longer life than the other charging rollers, meeting specific printing requirements and applications of the individual users.

On the other hand, while the Japanese Unexamined Patent Publication No. 2005-346028 discloses that the charging rollers electrically charge the photosensitive drums without contact, the Publication does not disclose or suggest any specific arrangement for switching the charging rollers between contact position with the corresponding photosensitive drums and non-contact position with the corresponding photosensitive drums.

SUMMARY OF THE INVENTION

In light of the aforementioned problems of the conventional image forming apparatus, it is an object of the invention to provide an image forming apparatus allowing replacement of an often used charging roller at approximately the same time as other charging rollers and capable of producing high-quality color images while reducing the amount of ozone emission.

In order to achieve the foregoing object, an image forming apparatus according to the present invention includes a plurality of image forming units arranged in parallel, each image forming unit having an image carrying member and a charging roller disposed face to face with the image carrying member for electrically charging the image carrying member, and a shifting mechanism for selectively shifting at least one charging roller between a first position where the charging roller is brought into contact with the corresponding image carrying member to electrically charge the image carrying member in contact manner and a second position where the charging roller is moved away from the corresponding image carrying member to electrically charge the image carrying member in non-contact manner.

These and other objects, features and advantages of the invention will become more apparent upon a reading of the following detailed description along with the accompanying drawings.

DETAILED DESCRIPTION OF THE PREFERRED EMBODIMENTS

Figure 1:
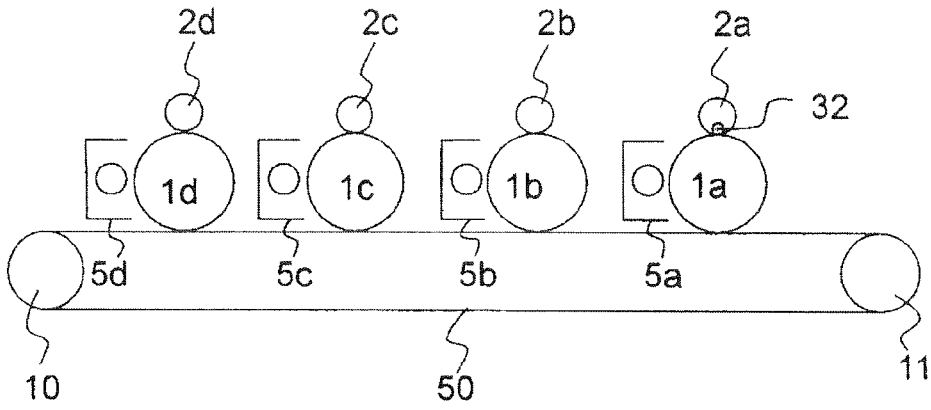
FIG. 1 is a schematic side view of part of a tandem-type color image forming apparatus according to a first embodiment of the invention illustrating, in particular, how image forming units, a transport belt and associated elements therearound are arranged in full-color mode.
Figure 2:
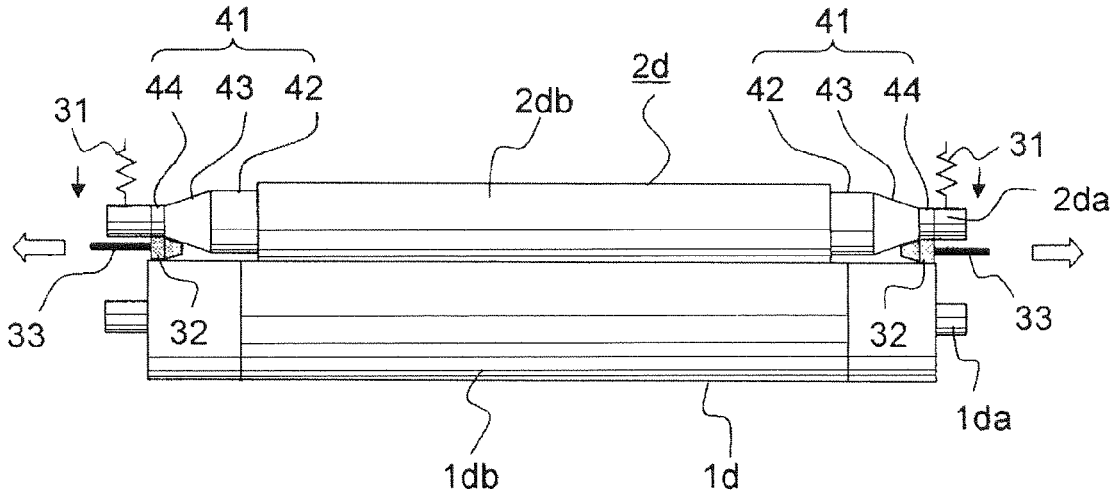
FIG. 2 is a schematic plan view showing part of the image forming apparatus around a charging roller and a photosensitive drum for black image forming as seen from a left side of FIG. 1.
Figure 3:
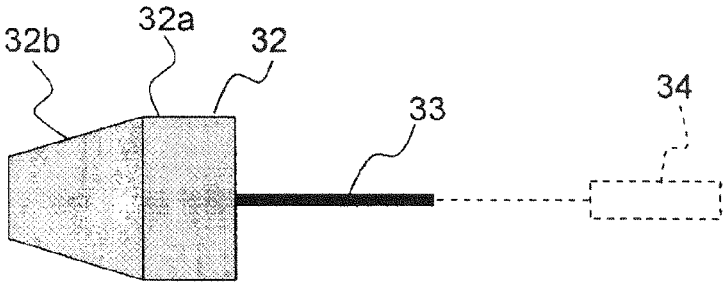
FIG. 3 is an enlarged schematic view of one of roller members.
Figure 7:
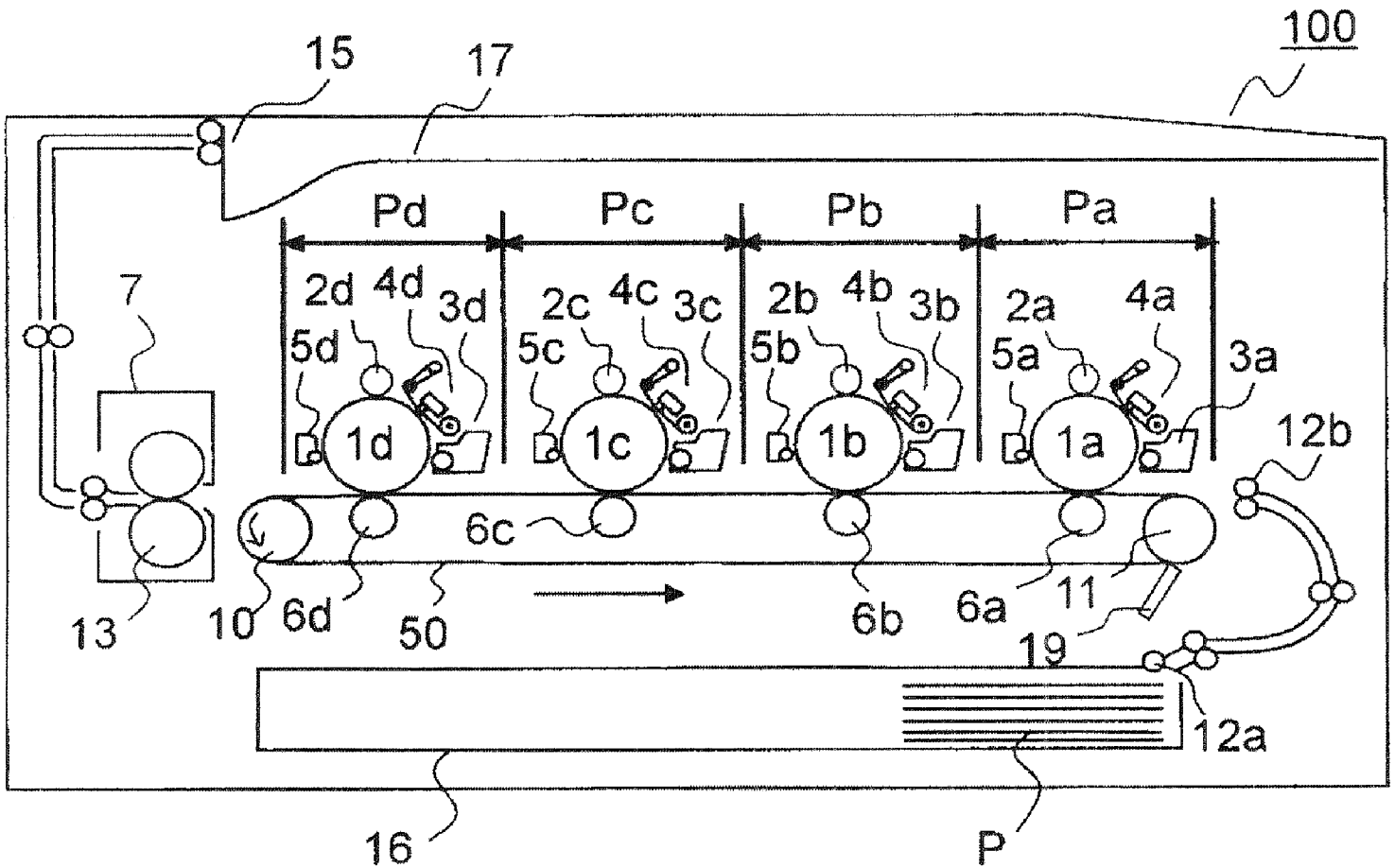
FIG. 7 is a schematic diagram generally showing the overall configuration of a conventional tandem-type color image forming apparatus.
Figure 8:
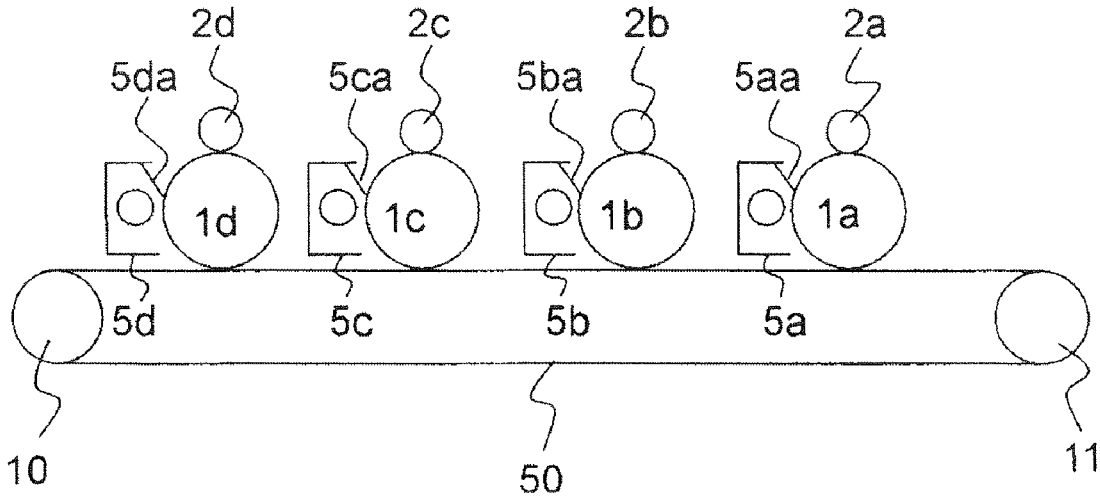
FIG. 8 is a schematic side view showing the configuration of a portion of the conventional tandem-type color image forming apparatus around charging rollers and photosensitive drums.

Preferred embodiments of the invention are now described in detail with reference to the accompanying drawings. FIG. 1 is a schematic side view of part of a tandem-type color image forming apparatus according to a first embodiment of the invention illustrating, in particular, how image forming units, a transport belt 50 and associated elements therearound are arranged in full-color mode, FIG. 2 is a schematic plan view showing part of the image forming apparatus around a charging roller 2*d* and a photosensitive drum 1*d* for black image forming as seen from a left side of FIG. 1, and FIG. 3 is an enlarged schematic view of one of roller members 32. Elements shown in FIGS. 1-3 which are identical or similar to those shown in FIGS. 7 and 8 are designated by the same reference numerals and a description of such elements is not given here. The cleaning blades 5*aa*, 5*ba*, 5*ca*, 5*da* are omitted in FIG. 7.

As shown in FIG. 1, the image forming apparatus 100 includes a photosensitive drum 1*a* on which a cyan image is formed, a photosensitive drum 1*b* on which a magenta image is formed, a photosensitive drum 1*c* on which a yellow image is formed, which drums 1*a* to 1*c* are rotatably mounted in this order from an upstream side to a downstream side. The image forming apparatus 100 further includes a photosensitive drum 1*d* which is disposed on the most downstream side and on which a black image is formed. A transport belt 50 is tensioned between a driving roller 10 and a driven roller 11. When driven by the driving roller 10, the transport belt 50 turns counterclockwise in contact with the cyan photosensitive drum 1*a*, the magenta photosensitive drum 1*b*, the yellow photosensitive drum 1*c*, the black photosensitive drum 1*d* and the driven roller 11.

A plurality of charging rollers 2*a*, 2*b*, 2*c*, 2*d* are mounted above the photosensitive drums 1*a* to 1*d* in parallel and opposed relation to the corresponding photosensitive drums 1*a* to 1*d* for electrically charging surfaces of the corresponding photosensitive drums 1*a*, 1*b*, 1*c*, 1*d* while rotating in contact with the photosensitive drums 1*a* to 1*d*. While solid-type rubber rollers employing electrically conductive epichlorohydrin rubber whose surface layer has a resistance of $10^5$ to $10^6$• and surface roughness $R_z$=10 μm can preferably be used as the charging rollers 2*a* to 2*d*, for example, the invention is not limited thereto. Alternatively, the charging rollers 2*a* to 2*d* may be of a sponge type expanded rubber rollers with protective tubing, or electrically conductive brushes. The charging rollers 2*a* to 2*d* are supported by a main apparatus body of the image forming apparatus 100 and are pressed against the corresponding photosensitive drums 1*a* to 1*d* with a specific nip pressure so that the charging rollers 2*a* to 2*d* follow the rotation of the photosensitive drums 1*a* to 1*d*, respectively.

As depicted in FIG. 2, a roller shaft 2*da* of the charging roller 2*d* is forced against the photosensitive drum 1*d* (in a direction shown by an arrow) by a pair of coil springs (biasing members) 31. In the full-color mode, the charging roller 2*d* is held in contact with the photosensitive drum 1*d* which is supported by a roller shaft 1*da*, and a charging part 2*db* of the charging roller 2*d* is pressed against a charged part (drum surface) 1*db* of the photosensitive drum 1*d* with the specific nip pressure (first position). Further, roller members (shifting members) 32 are positioned between ends of the charging roller 2*d* and corresponding ends of the photosensitive drum 1*d* and are mounted rotatably on ends of supporting shafts 33 extending in an axial or width direction of the roller member 32.

Since these two roller members 32 have the same configuration, the roller member 32 shown on the right side in FIG. 2 is now described in detail. As shown in FIG. 3, the roller member 32 includes a cylindrical supporting part 32*a* and a sliding part 32*b*. The sliding part 32*b* extends inward (leftward as illustrated) from the supporting part 32*a* in an axial or width direction of the supporting part 32*a* and has a tapered outer peripheral surface. In other words, the sliding part 32*b* extends from the supporting part 32*a* in a later-mentioned entering direction of the roller member 32. As will be discussed later, the supporting part 32*a* is configured to support a contact part 42 of the charging roller 2*d* whereas the sliding part 32*b* is configured to force a tapered part 43 of the charging roller 2*d* upward.

The supporting shaft 33 can be moved in an axial or width direction of the roller member 32 (left/right direction as illustrated in FIGS. 2 and 3) by means of solenoid (a moving member of a shifting mechanism) 34 shown by broken lines in FIG. 3. The solenoid 34 is controllably actuated by an unillustrated controller and can shift the roller member 32 outward in the axial or width direction in the full-color mode and inward in the axial or width direction in monochrome mode.

On the other hand, the charging roller 2*d* has at both ends of the charging part 2*db* a pair of roller shifting portions 41 as shown in FIG. 2. Each of the roller shifting portions 41 includes the cylindrical contact part 42 which goes into contact with the supporting part 32*a* of the roller member 32 and becomes supported by the supporting part 32*a* in the monochrome mode, the tapered part 43 extending from the contact part 42 in an axial or width direction of the contact part 42 and having a tapered outer peripheral surface with which the sliding part 32*b* of the roller member 32 goes into sliding contact, and a cylindrical end part 44 extending outward from the tapered part 43 in an axial or width direction of the tapered part 43 and having a smaller diameter than the contact part 42. The end part 44, the tapered part 43 and the contact part 42 are formed in this order as seen from the later-mentioned entering direction of the roller members 32. The roller shifting portion 41 may be formed as an integral part of the charging roller 2*d* or as a separate part which is fixed to the charging roller 2*d*.

When the full-color mode is set, the roller members 32 on left and right sides are shifted outward in the axial or width direction away from the charging part 2*db* of the charging roller 2*d* as shown by open arrows in FIG. 2 by a pair of solenoids 34 (FIG. 3) and, as a consequence, the charging roller 2*d* forced towards the photosensitive drum 1*d* by a biasing force exerted by the pair of coil springs 31 goes into contact with the photosensitive drum 1*d*. At this time, the supporting parts 32*a* of the roller members 32 go into contact with the end parts 44 of the charging roller 2*d*, and a nip pressure between the charging part 2*db* of the charging roller 2*d* and the charged part 1*db* of the photosensitive drum 1*d* can be adjusted to a specific nip pressure (contact pressure).

It is possible to produce a full-color image if all of the photosensitive drums 1*a* to 1*d* are electrically charged under conditions where the charging rollers 2*a* to 2*d* are held in contact with the respective photosensitive drums 1*a* to 1*d*. This contact charging approach makes it possible to perform a stable charging of the photosensitive drums 1*a* to 1*d* for the individual colors and produce high-quality full-color images at all times.

Figure 4:
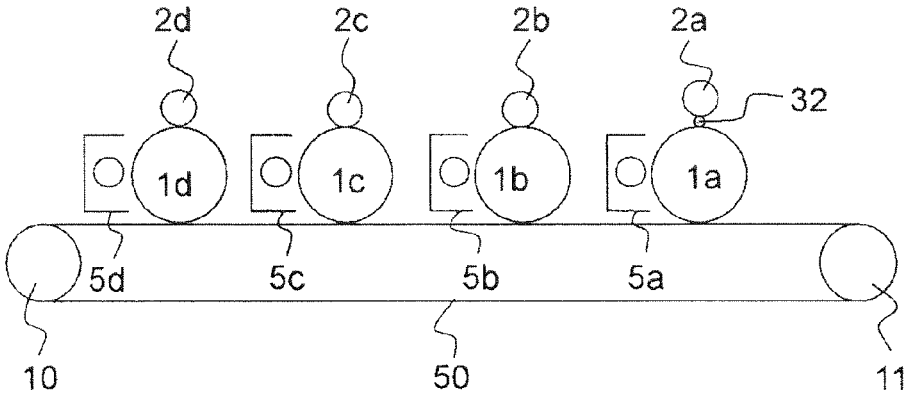
FIG. 4 is a schematic side view of the same part of the tandem-type color image forming apparatus according to the first embodiment of the invention as shown in FIG. 1 illustrating, in particular, how the image forming units, the transport belt and the associated elements therearound are arranged in monochrome mode.
Figure 5:
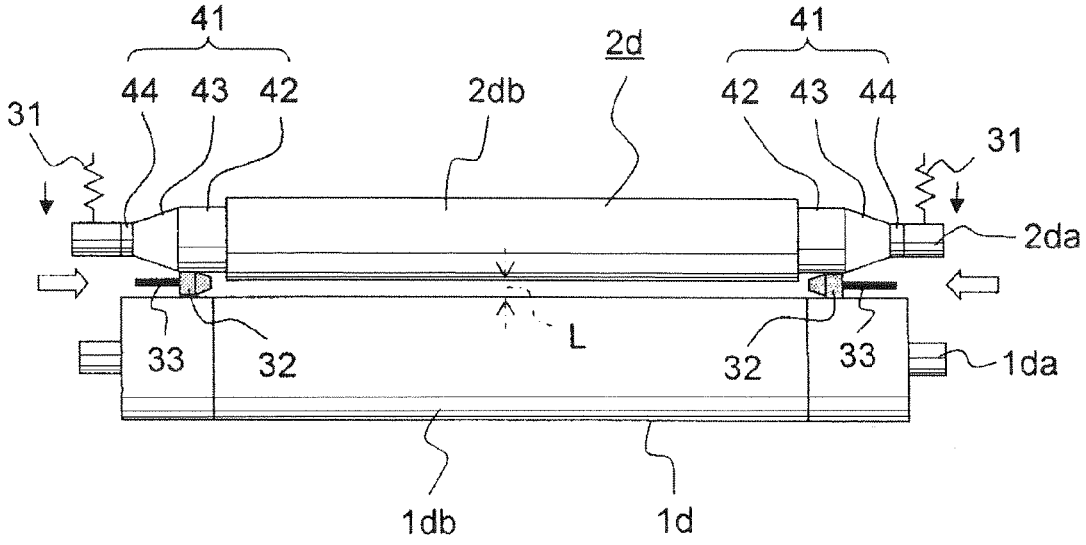
FIG. 5 is a schematic plan view showing the same part of the image forming apparatus around the charging roller and the photosensitive drum for black image forming as seen from a left side of FIG. 4.

FIG. 4 is a schematic side view of the same part of the tandem-type color image forming apparatus according to the first embodiment as shown in FIG. 1 illustrating, in particular, how the image forming units, the transport belt 50 and the associated elements are arranged in the monochrome mode, and FIG. 5 is a schematic plan view showing the same part of the image forming apparatus around the charging roller 2*d* and the photosensitive drum 1*d* for black image forming as seen from a left side of FIG. 4. Elements shown in FIGS. 4 and 5 which are identical or similar to those shown in FIGS. 1 and 2 are designated by the same reference numerals and a description of such elements is not given here.

When the monochrome mode is set, on the other hand, the pair of solenoids 34 (FIG. 3) is activated to move the roller members 32 inward in the width direction as shown by open arrows in FIG. 5, so that the roller members 32 enter deeper between ends of the charging roller 2*d* and the corresponding ends of the photosensitive drum 1*d*. The sliding parts 32*b* of the roller members 32 slide on surfaces of the corresponding tapered parts 43 of the charging roller 2*d* in the entering direction of the roller members 32, overwhelming the downward biasing force exerted by the coil springs 31 in a direction shown by arrows in FIG. 5, thereby shifting the charging roller 2*d* upward.

Next, the supporting parts 32*a* (FIG. 3) of the roller members 32 go into contact with the contact parts 42 of the charging roller 2*d* and stops at positions where the supporting parts 32*a* can support the charging roller 2*d*. As a result, the charging roller 2*d* is spaced at a specified distance L apart from the photosensitive drum 1*d* (second position). The charging roller 2*d* electrically charges the photosensitive drum 1*d* under conditions where the charging roller 2*d* is set apart from the photosensitive drum 1*d* (non-contact charging), making it possible to produce a monochrome image.

Since the charging roller 2*d* is set apart from the photosensitive drum 1*d* as discussed above in the monochrome mode, an external toner additive or the like which flows into a gap between the charging roller 2*d* and the photosensitive drum 1*d* without being scraped off by the cleaning blade 5*da* is not nipped between the charging roller 2*d* and the photosensitive drum 1*d* but is allowed to pass through the gap.

It is therefore possible to prevent the external toner additive or the like from adhering to the charging roller 2*d* in monochrome printing which is still more often required than color printing in commercial applications, thereby permitting an extended useful life of the charging roller 2*d*. Also, in the full-color mode, the charging roller 2*d* charges the photosensitive drum 1*d* in contact with the photosensitive drum 1*d* as the other photosensitive drums 1*a*-1*c* do, so that all of the charging rollers 2*a* to 2*d* deteriorate generally in the same way. As a result, the useful life of the charging roller 2*d* is approached to that of the other charging rollers 2*a* to 2*c*, making it possible to replace the four charging rollers 2*a* to 2*d* almost at the same time.

The distance L, if set to a small value, may become too small in part due to, for example, deflection of the charging roller 2*d* or the photosensitive drum 1*d*, potentially causing the risk of adhesion of the external toner additive or the like to the charging roller 2*d*. Contrary to this, if the distance L is made large, it may become difficult to uniformly charge the photosensitive drum 1*d*. To prevent such problems, it is preferable that the distance L between the charging roller 2*d* and the photosensitive drum 1*d* be set within a range of approximately 0.02 mm to 0.2 mm.

Incidentally, compared to the contact charging, the non-contact charging used in the monochrome mode may potentially cause less uniformity in charging. However, the arrangement of the present embodiment makes it possible to produce monochrome images of sufficiently high quality from a practical viewpoint. Although it is necessary to apply an increased voltage to the charging roller 2*d* for charging the photosensitive drum 1*d* since the non-contact charging is used in the monochrome mode for the charging roller 2*d*, it is not necessary to apply so large a voltage as in a corotron (or scorotron) system. Thus, it is possible to significantly reduce the amount of ozone emission than in the corotron system.

The image forming apparatus of the present embodiment is configured such that the photosensitive drum 1*d* is charged by the charging roller 2*d* held in contact with or set apart from the photosensitive drum 1*d* selectively as discussed above. Specifically, in the often selected monochrome mode the photosensitive drum 1*d* is charged by the charging roller 2*d* set apart from the photosensitive drum 1*d*, whereas, in the full-color mode, the photosensitive drums 1*a* to 1*d* are charged by the charging rollers 2*a* to 2*d* held in contact with the photosensitive drum 1*a* to 1*d*. This arrangement of the embodiment makes it possible not only to generally match replacement timing of the charging roller 2*d* with that of the other photosensitive drums 1*a*-1*c* but also to produce high-quality color images at all times while reducing the amount of ozone emission.

In the first embodiment, the coil springs 31, the roller members 32 and the solenoids 34 together constitute the shifting mechanism, so that the charging roller 2*d* can be brought into contact with and set apart from the photosensitive drum 1*d* without the need to make the apparatus larger or more complex. The shifting mechanism is not however limited to this configuration but may be configured by using cams or the like instead of the solenoids 34, for instance. It is also possible to use tension springs instead of the coil springs 31 for biasing the charging roller 2*d* downward from the side of the photosensitive drum 1*d*.

In the first embodiment, each of the roller members 32 is structured to include the supporting part 32*a* and the sliding part 32*b*. Also, the roller members 32 can be inserted into between the charging roller 2*d* and the photosensitive drum 1*d* from outside in the axial direction as shown in FIG. 5, and the roller members 32 can be moved away from between the charging roller 2*d* and the photosensitive drum 1*d*, as shown in FIG. 3. Also, the charging roller 2*d* has the roller shifting portions 41 at both ends, each of the roller shifting portions 41 including the contact part 42, the tapered part 43 and the end part 44. Accordingly, it is easy to insert the roller members 32 into between the charging roller 2*d* and the photosensitive drum 1*d* and to move the roller members 32 away from between the charging roller 2*d* and the photosensitive drum 1*d*. Furthermore, since the sliding parts 32*b* of the roller members 32 support the charging roller 2*d* when the charging roller 2*d* is brought into contact with the photosensitive drum 1*d* and is moved away from the photosensitive drum 1*d*, it is easy to bring the charging roller 2*d* smoothly into contact with the photosensitive drum 1*d* and to move the charging roller 2*d* away from the photosensitive drum 1*d* while avoiding damages to the charging roller 2*d* and the photosensitive drum 1*d*.

While the first embodiment employs the roller members 32, the invention is not particularly limited to this configuration but may employ any appropriate member which can be inserted between the charging roller 2*d* and the photosensitive drum 1*d* and moved away from between the charging roller 2*d* and the photosensitive drum 1*d* and which can be sandwiched between the charging roller 2*d* and the photosensitive drum 1*d* while the charging of the charging roller 2*d* to the photosensitive drum 1*d* is performed. In addition, the roller member 32 is not particularly limited to the above-described structure.

The image forming apparatus of the first embodiment is configured to include the black photosensitive drum 1*d* and the charging roller 2*d* for black image forming as well as the photosensitive drums 1*a* to 1*c* and the charging rollers 2*a* to 2*c* for color image forming, wherein the charging roller 2*d* can be brought into contact with and set apart from the photosensitive drum 1*d*. This configuration of the embodiment is advantageous from a practical viewpoint as it is possible to decrease the rate of deterioration of the charging roller 2*d* which is generally more often used in commercial applications.

Additionally, the image forming apparatus of the first embodiment is configured such that the charging rollers 2*a* to 2*c* are held in contact with the corresponding photosensitive drums 1*a* to 1*c* for color image forming at all times whereas the charging roller 2*d* is held in contact with the photosensitive drum 1*d* in the full-color mode and moved away from the photosensitive drum 1*d* in the monochrome mode. This configuration of the embodiment makes it possible to decrease the rate of deterioration of the charging roller 2*d* and produce higher-quality color images at all times.

In the first embodiment so far described the most often used charging roller 2*d* for black image forming is brought into contact with and set apart from the photosensitive drum 1*d*. The invention is not limited to this configuration, however, but includes such a modified form of the embodiment in which, according to required conditions and applications of a particular user, the most often used one of the charging rollers 2*a* to 2*d* for forming a particular color image is brought into contact with and set apart from the corresponding one of the photosensitive drums 1*a* to 1*d* depending on whether the full-color mode or special color mode is selected, for example. Specifically, if the user most often requires prints in magenta, for example, the embodiment may be modified such that the magenta charging roller 2*b* can be brought into contact with and set apart from the magenta photosensitive drum 1*b*.

Figure 6:
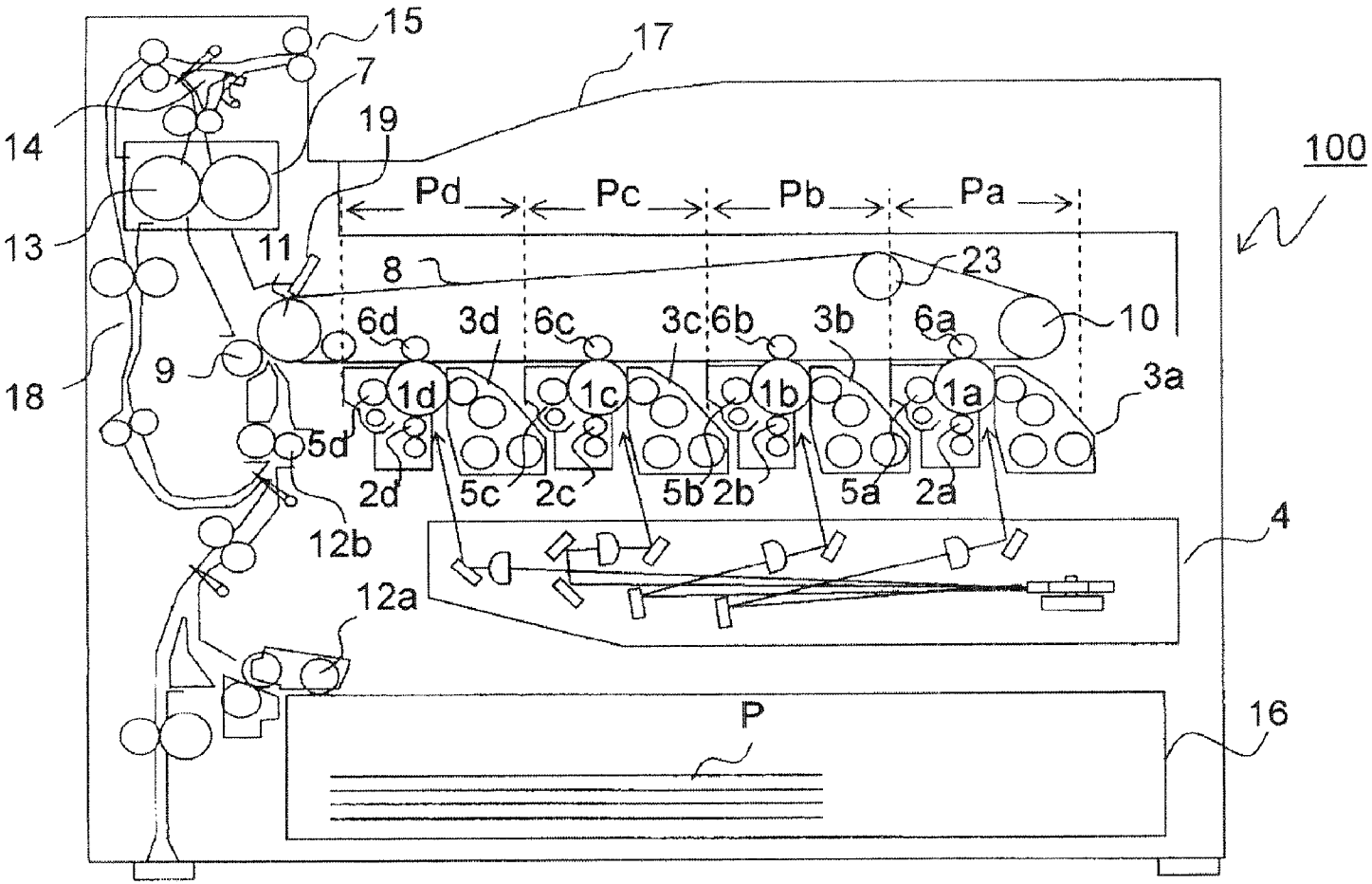
FIG. 6 is a schematic diagram generally showing the overall configuration of a tandem-type color image forming apparatus according to a second embodiment of the invention.

FIG. 6 is a schematic diagram generally showing the overall configuration of a tandem-type color image forming apparatus 100 according to a second embodiment of the invention. The image forming apparatus 100 employs an intermediate transfer belt 8 which is mounted on a driving roller 10 and a driven roller 11 and kept taut by a tension roller 23, instead of the transport belt 50 of the first embodiment, and toner images formed on photosensitive drums 1*a* to 1*d* are first transferred to the intermediate transfer belt 8 sequentially (primary transfer) by transfer rollers 6*a* to 6*d* and, then, together transferred to a sheet P (secondary transfer) by a secondary transfer roller 9.

In addition, image forming units Pa to Pd are disposed below the intermediate transfer belt 8 and the image forming apparatus 100 of this embodiment is provided with an exposure unit 4, instead of the LED heads 4*a* to 4*d*, for forming electrostatic latent images on the photosensitive drums 1*a* to 1*d*. The image forming apparatus 100 of the second embodiment is configured in otherwise the same way as that of the first embodiment, so that the configuration of the image forming apparatus 100 of this embodiment is not further described.

It should be understood that the foregoing first and second embodiments by no means limit the present invention but, rather, these illustrative embodiments may be altered or modified in various ways without departing from the spirit and scope of the invention. For example, while one of the charging rollers 2*a* to 2*d* is brought into contact with and set apart from the corresponding one of the photosensitive drums 1*a* to 1*d* in the foregoing embodiments, if two-color prints are most often produced, two of the charging rollers 2*a* to 2*d* may be provided with respective shifting mechanisms so that two of the charging rollers 2*a* to 2*d* can be brought into contact with and set apart from the corresponding two of the photosensitive drums 1*a* to 1*d*.

Furthermore, while the image forming apparatuses of the illustrative embodiments employ the a-Si type photosensitive drums 1*a* to 1*d*, the invention is not particularly limited thereto but it is possible to employ organic photosensitive drums yet obtaining the same operational and working effects as offered by the foregoing embodiments. Also, the aforementioned configuration of each embodiment may be modified such that the charging rollers 2*a* to 2*d* are combined (i.e., modularized) with the corresponding photosensitive drums 1*a* to 1*d* to form modular units for the individual colors. Moreover, while the invention has been described, by way of example, with reference to the illustrative embodiments in which the image forming apparatus 100 is a tandem-type color printer provided with a plurality of image forming units, the present invention is not limited thereto but is applicable to other types of image forming apparatuses, such as a copying machine and a facsimile machine.

Now, the invention is further discussed with reference to a Practical Example and Comparative Examples. It is to be noted, however, that the invention is not limited to these specific Examples.

Practical Example

Using the tandem-type color image forming apparatus of the first embodiment shown in FIG. 1, monochrome and full-color images were printed out under below-mentioned conditions.

The photosensitive drums 1*a*-1*d* used for the experiments were a-Si type photosensitive drums having a diameter of 30 mm and having a surface potential of 350 V. In the monochrome mode, only the charging roller 2*d* was operated to charge the photosensitive drum 1*d* with a distance of 20 μm therebetween. Charging conditioned included a DC voltage Vdc of 1000 V and a peak-to-peak AC voltage Vpp of 1400 V. Under these charging conditions, a text image having a coverage rate of 5% was printed.

In the full-color mode, the photosensitive drums 1*a*-1*d* were electrically charged by the charging rollers 2*a* to 2*d* kept in contact with the corresponding photosensitive drums 1*a* to 1*d*. Charging conditions included a DC voltage Vdc of 500 V and the peak-to-peak AC voltage Vpp of 1400 V. Under these charging conditions, a half-tone image having a coverage rate of 5% was printed. Running test was performed by printing monochrome and full-color images at a ratio of 2:6 (monochrome:full-color) in terms of the number of prints at normal ambient temperature and humidity (20° C., 60% RH).

At the beginning of the test, documents of both monochrome and full-color images for image evaluation were printed. Subsequently, monochrome and full-color image documents for evaluation were printed at regular intervals. The printed documents were evaluated in terms of image quality and hardware durability. Results of image quality evaluation of the monochrome images are classified into three different grades using the following symbols: "○" representing monochrome images with a clear text, "Δ" representing monochrome images with a slightly unclear text, and "X" representing monochrome images with an obviously unclear text.

Likewise, results of image quality evaluation of the full-color images are classified into three different grades using the following symbols: "○" representing half-tone images without density unevenness, "Δ" representing half-tone images with noticeable density unevenness, and "X" representing half-tone images with significant density unevenness. Further, evaluation results of durability of the charging rollers 2*a* to 2*d* made after printing 500,000 copies are classified into two grades using the following symbols: "○" representing a case where no anomalies in image, such as fogging or streaky marks on prints caused by dirt on the charging rollers 2*a* to 2*d*, are identified, and "X" representing the occurrence of any of such anomalies in image is identified.

COMPARATIVE EXAMPLE 1

In both the monochrome mode and the full-color mode, all of the charging rollers 2*a* to 2*d* were held in contact with the corresponding photosensitive drums 1*a*-1*d*. Only the charging roller 2*d* was activated to charge the photosensitive drum 1*d* alone in the monochrome mode to produce monochrome images, whereas all of the charging rollers 2*a* to 2*d* were activated to charge the four photosensitive drums 1*a*-1*d* in the full-color mode to produce full-color images, under the same charging conditions as used for the Practical Example in the full-color mode. Other conditions than the charging conditions were the same as that in the Practical Example, and running test of Comparative Example 1 was performed and the printed images were evaluated.

COMPARATIVE EXAMPLE 2

In both the monochrome mode and the full-color mode, all of the charging rollers 2*a* to 2*d* were set at a distance of 20 μm apart from the corresponding photosensitive drums 1*a*-1*d*. Under the same charging conditions as used for the Practical Example in the monochrome mode, only the charging roller 2*d* was activated to charge the photosensitive drum 1*d* alone in the monochrome mode to produce monochrome images whereas all of the charging rollers 2*a* to 2*d* were activated to charge the photosensitive drums 1*a*-1*d* in the full-color mode to produce full-color images. Running test of Comparative Example 2 was performed and the printed images were evaluated. Table 1 shows the results of the evaluation of the Practical and Comparative Examples.

TABLE 1

| Evaluation item | | Practical Example | Comparative Example 1 | Comparative Example 2 |
|---|---|---|---|---|
| Image quality | Monochrome images (Text images) | Δ | ○ | Δ |
| | Full-color images (Half-tone images) | ○ | ○ | Δ |
| Charging Roller durability | | ○ | X | ○ |

The results of image quality evaluation shown in Table 1 reveal that, generally, the monochrome images of Comparative Example 1 carry a highly legible clear text and the full-color images printed by Comparative Example 1 do not contain any noticeable density unevenness. In Comparative Example 1, however, the anomalies in image, such as fogging or streaky marks on prints caused by dirt on the charging rollers 2*a* to 2*d*, occurred before the image forming apparatus printed 500,000 copies. This suggests that the useful life of the charging roller 2*d* would be shortened if the charging rollers 2*a* to 2*d* are held in contact with the photosensitive drum 1*d* for charging the latter.

On the other hand, the results of image quality evaluation shown in Table 1 reveal that although the monochrome images printed by Comparative Example 2 contain a slightly unclear text, the printed text is sufficiently legible and satisfies a quality standard which is commercially well acceptable from a practical viewpoint. As regards the hardware durability, no anomalies in image quality, such as fogging or streaky marks on prints caused by dirt on the charging rollers 2*a* to 2*d*, were identified in Comparative Example 2 even after the image forming apparatus printed 500,000 copies. The full-color images printed by Comparative Example 2, however, exhibit density unevenness, indicating that Comparative Example 2 does not satisfy a commercially acceptable quality standard for full-color printing which requires high accuracy and quality.

The results of image quality evaluation of the Practical Example shown in Table 1 reveal that although the monochrome images printed by the Practical Example contained a slightly unclear text, the printed text was sufficiently legible and a quality standard which is commercially well acceptable from a practical viewpoint. No density unevenness was noticed in the full-color images printed by the Practical Example, indicating also that the Practical Example satisfies the commercially acceptable quality standard for full-color printing which requires high accuracy and quality. Moreover, no anomalies in image quality, such as fogging or streaky marks on prints caused by dirt on the charging rollers 2*a* to 2*d*, were identified in the Practical Example even after the image forming apparatus printed 500,000 copies.

The results of the test of the Practical Example can be summarized as follows: no dirt or grime was found not only on the charging rollers 2*a*-2*c* which are less used but kept in constant contact with the photosensitive drums 1*a*-1*c* for color image forming but also on the charging roller 2*d* which is normally most often used but kept in contact with the photosensitive drum 1*d* in the full-color mode and set apart from the photosensitive drum 1*d* in the monochrome mode.

In light of the foregoing, all of the charging rollers 2*a* to 2*d* may be together replaced when the number of prints produced by the image forming apparatus has reached 500,000. Taking into consideration the aforementioned results, it may be a good practice to replace all of the charging rollers 2*a* to 2*d*, for example, when the number of prints produced by the image forming apparatus has reached 400,000, that is, when the image forming apparatus has printed 400,000 images by using the charging roller 2*d* and 300,000 images by using the charging rollers 2*a*-2*c*.

From the aforementioned results of the running test, it has been found that it is possible to produce full-color images and monochrome images of a practically sufficient image quality by charging the photosensitive drums 1*a* to 1*d* by all of the charging rollers 2*a* to 2*d* held in contact with the respective photosensitive drums 1*a*-1*c* in the full-color mode and charging only the photosensitive drum 1*d* by the charging roller 2*d* set apart from the photosensitive drum 1*d* in the monochrome mode. It has also been found that the above-described arrangements of the present invention make it possible to decrease the rate of deterioration of the most often used charging roller 2*d* and replace the charging roller 2*d* at the same time as the other charging rollers 2*a*-2*c*. It should be understood that the arrangements of the foregoing first and second embodiments are simply illustrative of the invention, and the ratio of the number of monochrome prints to the number of full-color prints and the total number of prints referred to in determining charging roller replacement timing may be determined by conducting preliminary testing, for example.

While the invention has thus far been described with reference to the illustrative embodiments thereof, the image forming apparatus preferably includes the following features.

Specifically, the image forming apparatus includes a plurality of image forming units arranged in parallel, each image forming unit having an image carrying member and a charging roller disposed face to face with the image carrying member for electrically charging the image carrying member, and a shifting mechanism for selectively shifting at least one charging roller between a first position where the charging roller is brought into contact with the corresponding image carrying member to electrically charge the image carrying member in contact manner and a second position where the charging roller is moved away from the corresponding image carrying member to electrically charge the image carrying member in non-contact manner.

In the image forming apparatus, the shifting mechanism makes it possible that the charging roller is selectively held in contact with or moved away from the corresponding image carrying member to electrically charge the image carrying member. According to this feature, when an image of a particular color which is most often used is formed, the charging roller is shifted to the second position to charge the image carrying member corresponding to the particular color with a distance therebetween. On the other hand, when a full-color image is formed, that charging roller is shifted to the first position where all of the charging rollers are held in contact with the corresponding image carrying members, and charge the corresponding image carrying members.

In the above image forming apparatus, the shifting mechanism preferably includes a biasing member for biasing the charging roller toward the corresponding image carrying member, a shifting member capable of entering between the charging roller and the image carrying member against the biasing force of the biasing member to shift the charging roller to the second position and also capable of moving away from between the charging roller and the image carrying member to shift the charging roller to the first position, and a moving member capable of inserting the shifting member between the charging roller and the image carrying member and of retracting the shifting member from therebetween.

According to the above feature, the shifting member is inserted between the charging roller and the corresponding image carrying member against the biasing force of the biasing member to cause the charging roller be shifted to the second position. On the other hand, the shifting member is moved away from between the charging roller and the corresponding image carrying member to cause the charging roller to be shifted to the first position with the aid of the biasing member. This feature makes it possible to shift the charging roller between the first position and the second position without the need to make the image forming apparatus larger or more complex.

In the above image forming apparatus, the image carrying member may be a photosensitive drum disposed parallel to the charging roller and fixed rotatably at a specific position. The shifting member may be a roller member so shaped as to enter a space formed between an end of the charging roller and a corresponding end of the photosensitive drum. The roller member includes, for example, a cylindrical supporting part and a sliding part extending from the supporting part in a direction in which the roller member enters the space, and having a tapered outer peripheral surface. In this case, the end of the charging roller is preferably provided with a tapered part having a tapered outer peripheral surface on which the sliding part can slide and a cylindrical contact part, the tapered part and the contact part formed in this order as seen from the entering direction of the roller member. When the roller member enters the space, the sliding part first slides on the tapered part to move the charging roller away from the corresponding photosensitive drum and then, the supporting part goes into contact with the contact part to stay between the contact part and the end of the photosensitive drum, whereby the charging roller is shifted to the second position.

According to the above feature, when the roller member is inserted into the space formed between the end of the charging roller and the corresponding end of the photosensitive drum, the sliding part first slides on the tapered part to move the charging roller away from the photosensitive drum. Then, the supporting part goes into contact with the contact part and is positioned between the contact part and the end of the photosensitive drum, thereby shifting the charging roller to the second position. Accordingly, the charging roller can be easily shifted between the first position and the second position while avoiding damages to the charging roller and the photosensitive drum.

In the above image forming apparatus, the end of the charging roller may be further provided with a cylindrical end part formed on the tapered part as seen from the entering direction of the shifting member. When the roller member is moved away from between the contact part and the end of the photosensitive drum to shift the charging roller to the first position, the supporting part of the roller member is positioned between and in contact with the end part and the end of the photosensitive drum by the biasing force of the biasing member. The end part preferably has a diameter that is determined such that the charging roller and the photosensitive drum are held in contact with each other with a specific contact pressure.

This configuration makes it possible to set the contact pressure (nip pressure) exerted between the charging roller and the photosensitive drum at an appropriate level, so that the charging roller can properly charge the corresponding photosensitive drum.

In the above image forming apparatus, when the charging roller is shifted to the second position, the distance between an outer peripheral surface of the charging roller and an outer peripheral surface of the photosensitive drum is preferably set within a range of 0.02 mm to 0.2 mm.

If the distance between the outer peripheral surface of the charging roller and that of the photosensitive drum is smaller than 0.02 mm, the distance can become too small in part due to deflection of the charging roller or the photosensitive drum, potentially causing the risk of adhesion of an external toner additive or the like to the charging roller. Contrary to this, if the distance exceeds 0.2 mm, it may become difficult to uniformly charge the photosensitive drum.

In the above image forming apparatus, the image carrying members preferably include a black image carrying member for forming a black image and a color image carrying member for forming a color image other than a black image. Also, the charging rollers preferably include a black charging roller for electrically charging the black image carrying member and a color charging roller for electrically charging the color image carrying member. In this case, the shifting mechanism may shift the black charging roller relative to the black image carrying member between the first position and the second position.

This configuration is advantageous from a practical viewpoint as it is possible to decrease the rate of deterioration of the black charging roller which is generally more often used in commercial applications.

When the shifting mechanism is configured to shift the black charging roller between the first position and the second position, the color charging roller is kept in contact with the color image carrying member at all times and the shifting mechanism shifts the black charging roller to the first position when a color image is formed and to the second position when a monochrome image is formed.

This configuration makes it possible to decrease the rate of deterioration of the black charging roller for electrically charging the black image carrying member and to produce higher-quality color images at all times.

In the above image forming apparatus, the image carrying members preferably include a black image carrying member for forming a black image and a plurality of color image carrying members for forming magenta, cyan and yellow images. Also, the charging rollers preferably include a black charging roller for electrically charging the black image carrying member and a plurality of color charging rollers for electrically charging the corresponding color image carrying members. In this case, the shifting mechanism may be configured to shift one of the color charging rollers relative to the corresponding color image carrying member between the first position and the second position.

Since some users may often produce prints in a particular color, the above feature is advantageous in decreasing the rate of deterioration of the charging roller used for forming images in that particular color, yet in producing higher-quality full-color images at all times. It will be appreciated from the foregoing that the image forming apparatus of the present invention can meet specific user requirements and applications in a flexible fashion.

This application is based on Japanese Patent application serial No. 2008-065418 filed in Japan Patent Office on Mar. 14, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a plurality of image forming units arranged in parallel, each image forming unit including a photosensitive drum and a charging roller disposed face to face with the photosensitive drum for electrically charging the photosensitive drum; and a shifting mechanism for selectively shifting at least one charging roller between a first position where the charging roller is brought into contact with the corresponding photosensitive drum to electrically charge the photosensitive drum in contact manner and a second position where the charging roller is moved away from the corresponding photosensitive drum to electrically charge the photosensitive drum in non-contact manner.

2. The image forming apparatus according to claim 1, wherein the photosensitive drums include a black photosensitive drum for forming a black image and a color photosensitive drum for forming a color image other than a black image;

wherein the charging rollers include a black charging roller for electrically charging the black photosensitive drum and a color charging roller for electrically charging the color photosensitive drum, and wherein the shifting mechanism shifts the charging roller relative to the black photosensitive drum between the first position and the second position.

3. The image forming apparatus according to claim 2, wherein the color charging roller is kept in contact with the color photosensitive drum at all times; and wherein the shifting mechanism shifts the black charging roller to the first position when a color image is formed and to the second position when a monochrome image is formed.

4. The image forming apparatus according to claim 1, wherein the photosensitive drums include a black photosensitive drum for forming a black image and a plurality of color photosensitive drums for forming magenta, cyan and yellow images;

wherein the charging rollers include a black charging roller for electrically charging the black photosensitive drum and a plurality of color charging rollers for electrically charging the corresponding color photosensitive drums; and wherein the shifting mechanism shifts one of the color charging rollers relative to the corresponding color photosensitive drum between the first position and the second position.

5. The image forming apparatus according to claim 1, wherein the shifting mechanism includes:

a biasing member for biasing the charging roller toward the corresponding photosensitive drum;

a shifting member capable of entering between the charging roller and the photosensitive drum against the biasing force of the biasing member to shift the charging roller to the second position, and also capable of moving away from between the charging roller and the photosensitive drum to shift the charging roller to the first position; and a moving member capable of inserting the shifting member between the charging roller and the photosensitive drum and of retracting the shifting member from therebetween.

6. The image forming apparatus according to claim 5, wherein the shifting member is a roller member so shaped as to enter a space formed between an end of the charging roller and a corresponding end of the photosensitive drum, the roller member including a cylindrical supporting part and a sliding part extending from the supporting part in a direction in which the roller member enters the space, and having a tapered outer peripheral surface;

wherein the end of the charging roller is provided with a tapered part having a tapered outer peripheral surface on which the sliding part slides and a cylindrical contact part, the tapered part and the contact part formed in this order as seen from the entering direction of the roller member; and wherein when the roller member enters the space, the sliding part first slides on the tapered part to move the charging roller away from the corresponding photosensitive drum and then, the supporting part goes into contact with the contact part to stay between the contact part and the end of the photosensitive drum, whereby the charging roller is shifted to the second position.

7. The image forming apparatus according to claim 6, wherein the end of the charging roller is further provided with a cylindrical end part formed on the tapered part as seen from the entering direction of the shifting member;

wherein when the roller member is moved away from between the contact part and the end of the photosensitive drum to shift the charging roller to the first position, the supporting part of the roller member is positioned between and in contact with the end part and the end of the photosensitive drum by the biasing force of the biasing member; and wherein the end part has a diameter that is determined such that the charging roller and the photosensitive drum are held in contact with each other with a specific contact pressure.

8. The image forming apparatus according to claim 7, wherein when the charging roller is shifted to the second position, the distance between an outer peripheral surface of the charging roller and an outer peripheral surface of the photosensitive drum is set within a range of 0.02 mm to 0.2 mm.

9. An image forming apparatus comprising:

a plurality of image forming units arranged in parallel, each of the image forming units including an image carrying member and a charging roller disposed face to face with the respective image carrying member for electrically charging the respective image carrying member; and a shifting mechanism for selectively shifting at least one charging roller between a first position where the charging roller is brought into contact with the corresponding image carrying member to electrically charge the image carrying member in a contact manner and a second position where the charging roller is moved away from the corresponding image carrying member to electrically charge the image carrying member in a non-contact manner, wherein the image carrying members include a black image carrying member for forming a black image and a color image carrying member for forming a color image other than a black image, wherein the charging rollers include a black charging roller for electrically charging the black image carrying member and a color charging roller for electrically charging the color image carrying member, wherein the color charging roller is kept in contact with the color image carrying member at all times, and wherein the shifting mechanism shifts the black charging roller to the first position relative to the black image carrying member when a color image is formed and to the second position when a monochrome image is formed.

10. The image forming apparatus according to claim 9, wherein the shifting mechanism includes:

a biasing member for biasing the charging roller toward the corresponding image carrying member;

a shifting member capable of entering between the charging roller and the image carrying member against the biasing force of the biasing member to shift the charging roller to the second position and also capable of moving away from between the charging roller and the image carrying member to shift the charging roller to the first position; and a moving member capable of inserting the shifting member between the charging roller and the image carrying member and of retracting the shifting member from therebetween.

11. The image forming apparatus according to claim 9, wherein each of the image carrying members is a photosensitive drum disposed parallel to the charging roller and fixed rotatably at a specified position.

12. An image forming apparatus comprising:

a black image forming unit including a black image carrying member for forming a black image and a black charging roller for electrically charging the black image carrying member;

a plurality of color image forming units arranged in parallel with the black image forming unit, each of the color image forming units including a color image carrying member for forming a color image other than a black image, and a color charging roller disposed face to face with the respective color image carrying member for electrically charging the respective color image carrying member, each of the color charging rollers being kept in contact with the respective color image carrying member at all times; and a shifting mechanism for selectively shifting the black charging roller between a first position where the black charging roller is brought into contact with the black image carrying member to electrically charge the black image carrying member in a contact manner and a second position where the black charging roller is moved away from the black image carrying member to electrically charge the black image carrying member in a non-contact manner, the shifting mechanism shifting the black charging roller to the first position relative to the black image carrying member when a color image is being formed and to the second position when a monochrome image is being formed.

* * * * *